US006754994B2

(12) United States Patent
Jahanpour

(10) Patent No.: US 6,754,994 B2
(45) Date of Patent: Jun. 29, 2004

(54) RETRACTABLE ROOF

(76) Inventor: Farahmand Jahanpour, 137 Beaufort Drive, London NW11 6DA (GB)

( * ) Notice: Subject to any disclaimer, the term of this patent is extended or adjusted under 35 U.S.C. 154(b) by 0 days.

(21) Appl. No.: 10/204,974

(22) PCT Filed: Feb. 13, 2001

(86) PCT No.: PCT/GB01/00597

§ 371 (c)(1),
(2), (4) Date: Sep. 13, 2002

(87) PCT Pub. No.: WO01/65020

PCT Pub. Date: Sep. 7, 2001

(65) Prior Publication Data

US 2003/0046879 A1 Mar. 13, 2003

(51) Int. Cl.[7] ..... E04B 7/16

(52) U.S. Cl. ..... 52/66; 52/65; 52/69; 52/81; 52/80; 52/83; 52/6; 52/7; 52/8

(58) Field of Search ..... 52/66, 65, 69, 52/81, 80, 83, 6, 7, 8

(56) References Cited

U.S. PATENT DOCUMENTS

| | | | | | |
|---|---|---|---|---|---|
| 3,510,996 | A | * | 5/1970 | Popil | 52/64 |
| 3,815,299 | A | * | 6/1974 | Sorensen et al. | 52/66 |
| 4,075,795 | A | * | 2/1978 | Thomas | 52/8 |
| 4,175,361 | A | * | 11/1979 | Kumode | 52/66 |
| 4,587,775 | A | * | 5/1986 | Lewis et al. | 52/65 |
| 4,676,033 | A | * | 6/1987 | Allen et al. | 52/6 |
| 4,706,419 | A | * | 11/1987 | Adachi et al. | 52/65 |
| 4,727,688 | A | * | 3/1988 | Kida et al. | 52/6 |
| 4,751,800 | A | * | 6/1988 | Kida et al. | 52/66 |
| 4,783,861 | A | * | 11/1988 | Leurent | 4/498 |
| 4,831,792 | A | * | 5/1989 | Berger | 52/66 |
| 4,942,698 | A | * | 7/1990 | Kumagai | 52/6 |
| 5,007,214 | A | * | 4/1991 | Itami et al. | 52/66 |
| 5,035,093 | A | * | 7/1991 | Parazader et al. | 52/64 |
| 5,062,243 | A | * | 11/1991 | Kumagai | 52/66 |
| 5,117,594 | A | * | 6/1992 | Muramoto et al. | 52/66 |
| 5,167,097 | A | * | 12/1992 | Robbie et al. | 52/6 |
| 5,189,851 | A | * | 3/1993 | Omika et al. | 52/66 |
| 5,257,481 | A | * | 11/1993 | Reppas et al. | 52/6 |
| 5,257,485 | A | * | 11/1993 | Kawaguchi et al. | 52/66 |
| 5,351,449 | A | * | 10/1994 | Allen et al. | 52/6 |
| 5,355,641 | A | * | 10/1994 | Levy | 52/66 |
| 5,577,350 | A | * | 11/1996 | Brisbin et al. | 52/6 |
| 5,848,499 | A | * | 12/1998 | Schildge, Jr. | 52/66 |
| 5,904,003 | A | * | 5/1999 | Stephen | 52/6 |
| 5,983,575 | A | * | 11/1999 | Reppas | 52/66 |
| 6,003,269 | A | * | 12/1999 | McRee | 52/6 |
| 6,367,206 | B1 | * | 4/2002 | Silberman et al. | 52/66 |

FOREIGN PATENT DOCUMENTS

| | | |
|---|---|---|
| EP | 0 210 276 | 2/1987 |
| GB | 2 188 957 A | 10/1987 |
| WO | 89/04896 | 6/1989 |

* cited by examiner

*Primary Examiner*—Carl D. Friedman
*Assistant Examiner*—Christy Green
(74) *Attorney, Agent, or Firm*—Dykema Gossett PLLC

(57) ABSTRACT

A system for operating a retractable roof having at least two moveable roof sections, the system comprising: a first support having a first pulley; a second support positioned opposite to and across from the first support means and having a second pulley; a tie member which passes around the first and second pulleys to form an elongate loop having a crossover point between the supports; wherein the first roof section is supported, in use, by the tie member between the first support and the crossover point and the second roof section is supported, in use, by the tie member between the crossover point and the second support such that, in use, the roof sections move in opposite directions when the tie member is moved.

14 Claims, 7 Drawing Sheets

RETRACTABLE ROOF

This invention relates to retractable roofs, and is particularly relevant to large-scale retractable roofs of the type employed to cover the centre of a stadium such as an athletics or football stadium.

Given the cost of building large stadia there has been an interest in recent years in providing stadia which can be a venue for many different uses, not only simply for a single sport or type of event. In addition, there has been created a need for stadia which can be used throughout the year, regardless of weather conditions, and at any time, day or night. This has produced an increasing need for stadia which have roofs which can be moved so that a stadium can provide a traditional outdoor venue, but can still be used under adverse weather conditions and/or when temperatures drop at night, without affecting the comfort of the users of the stadium.

In recent time there have been proposed, and, indeed, built, many stadia with such roofs. There are difficulties, however, in providing such roofs. Firstly, they can be extremely expensive and difficult to maintain given the support structures required to ensure rapid and reliable movement of the roof. In addition, the requirement of such roofs is such that they can increase significantly the overall cost of the stadia, given that their additional weight introduces additional structural burdens on the rest of the building. For example, it is usual to use arches, trusses or suchlike to support the roof across its entire span.

The present invention seeks to provide a roof which is retractable, but which can be employed to cover a large area and which has considerably reduced weight in comparison with known retractable roofs.

According to the present invention there is provided a system for operating a retractable roof having at least two movable roof sections, the system comprising:

a first support having a first pulley;

a second support positioned opposite to and across from the first support means and having a second pulley;

a tie member which passes around the first and second pulleys to form an elongate loop having a crossover point between the supports;

wherein the first roof section is supported, in use, by the tie member between the first support and the crossover point and the second roof section is supported, in use, by the tie member between the crossover point and the second support such that, in use, the roof sections move in opposite directions when the tie member is moved.

One of the pulleys may be provided with driving means, such as a motor and gearbox, for moving the tie member and thus operating the roof. The tie member may pass through each support twice to form a double loop arrangement to provide resistance to lateral movement. In this double loop arrangement, the tie member may be connected to each roof section in two places, one of which is a pulley point and the other is a fixed point, that is clamped to the tie member such that the roof section is caused to move with the tie member. The first and second roofs sections may, in use, be attached to the tie member at points equidistant from the cross over point.

Additional pulleys may be provided on each side of the crossover point between the support and the connection of the tie member to the roof section for controlling the path which the tie member takes and thus altering the direction of travel of the roof sections. If the additional pulleys are placed so as to lower the path of the tie member, then the direction of travel of the roof section will be made more convex/less concave. If the additional pulleys are placed so as to raise the path of the tie member, then the direction of travel of the roof section will be made more concave/less convex.

The position of the additional pulley may be controlled by, for example, a hydraulic ram. The ram may also adjust the tension of the tie member so that it is maintained at a substantially constant value to ensure that undue stresses are not placed on the system.

The roof sections may be arranged such that, when they are in the closed position, they are able to lock with one another to provide additional support to one another and to provide a rigid roof structure.

The present invention also provides a retractable roof having one or more systems for operation thereof, and in which the roof sections may be concave or convex.

Preferably, the roof is provided with two systems, each having two roof sections associated therewith, such that a total of four roof sections are provided. The roof may be provided with an outer section which is fixed in place and on which the retractable roof is movably mounted on rails The fixed outer section typically extends over nearly all of the spectator area within the stadium and usually the fixed section extends over approximately half the diameter of the roof. Alternatively, certain projects may require the fixed section to be smaller and thus it may cover only about one third of the roof diameter. In this arrangement, the roof sections may be formed from more than one roof element, such that, in the retracted position, the roof elements are stacked one on top of another, and, in the extended position, the elements are adjacent to each other to form a roof section.

The fixed outer section may be provided with retaining means for preventing the retractable roof sections from being lifted when in the retracted position, such as by a sudden updraft of wind. The retaining means preferably comprises a cable which is attached at one end to the fixed roof section, preferably the underside thereof, or to a ring beam and at the other end is slidably mounted on the underside of the retractable roof.

According to the invention there is also provided a stadium comprising a roof and system of the type described above. Such a stadium may comprise one or more roofs, each of which may have one or more corresponding systems.

Thus the present invention provides a roof which breaks the supporting span of the roof such that arches, trusses and suchlike are not required.

An example of the present invention will now be described with reference to the accompanying drawings, in which:

FIGS. 1 to 3 are schematic perspective views of a stadium roof employing a system of the present invention, showing the roof in a fully retracted, a partially closed, and a fully closed configuration;

FIGS. 4*a* and 4*b* are side views of a system according to the present invention;

FIG. 4C schematically illustrates a pulley arrangement employed in the invention;

FIGS. 5*a* and 5*b* are side views of a further example system according to the present invention;

Figure 1:
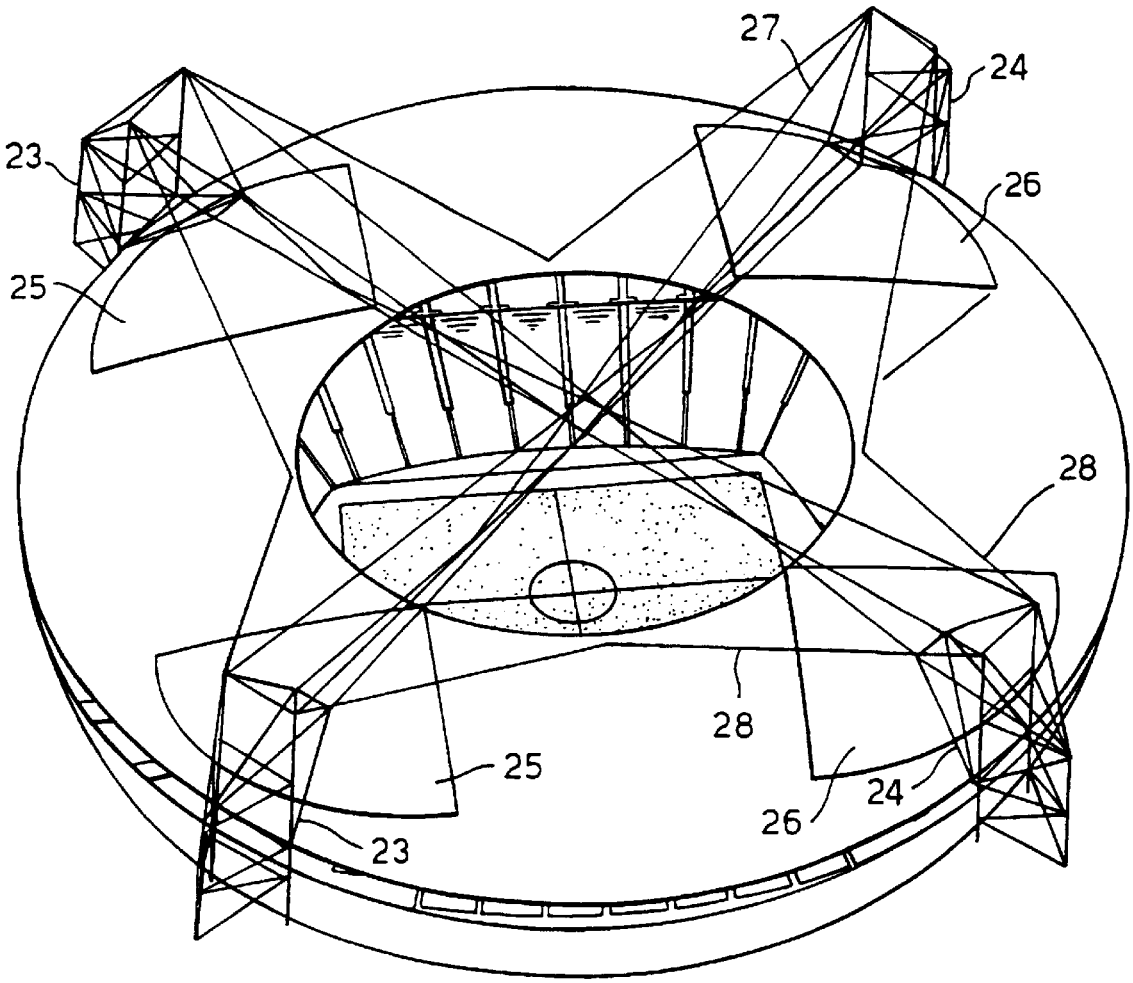

Referring to FIG. 1, a stadium roof 21 has a peripheral fixed region, and a central open region 22. In this case the overall shape of the roof 21 is oval as is that of the open region 22, although this does not have to be the case. The roof and/or the open region could be elliptical, circular, rectangular or any other shape. Associated with the roof 1 are two first supports 23 and two second supports 24. Each support has a movable roof section 25, 26 associated therewith and attached to its respective support 23, 24 via a tie member 27, which is a steel support cable or similar. Each support 23, 24, may also provide support for the fixed roof section via support cable 28.

Figure 2:
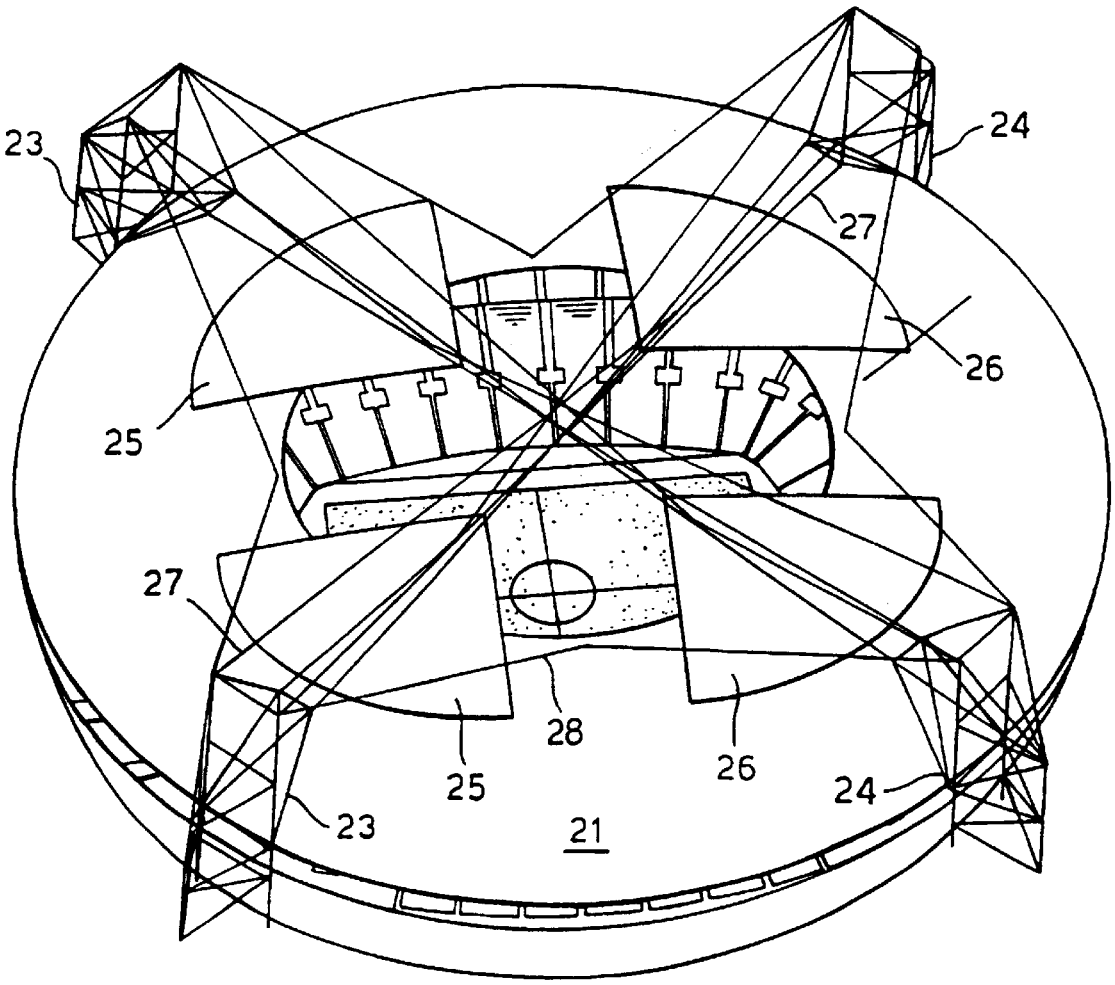

Each of the movable roof sections 25, 26 can be moved from a retracted position (FIG. 1) to a fully closed position (FIG. 3) via an intermediate position (FIG. 2). When in a closed position fixing members (not shown) may be moved to connect adjacent movable roof sections, 25, 26 to provide a rigid roof structure that is water-tight and which is resistant to up-drafts or down-drafts generated by weather conditions and conditions within the stadium beneath the roof 21.

In the example four movable roof sections are provided, although it would be appreciated that only two may be provided, or that more than four may be provided, just so long as there is an even number.

Figure 4A:
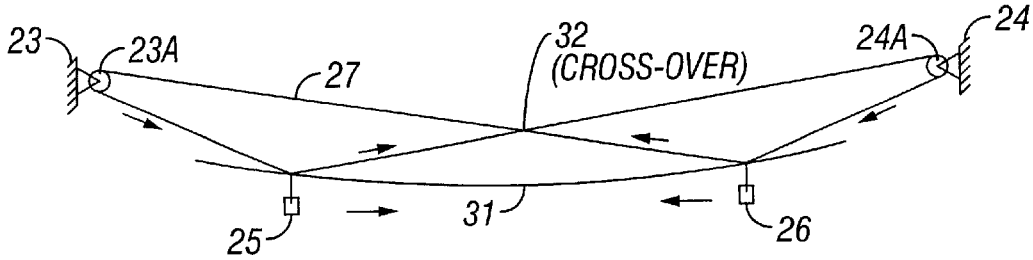
Figure 4B:
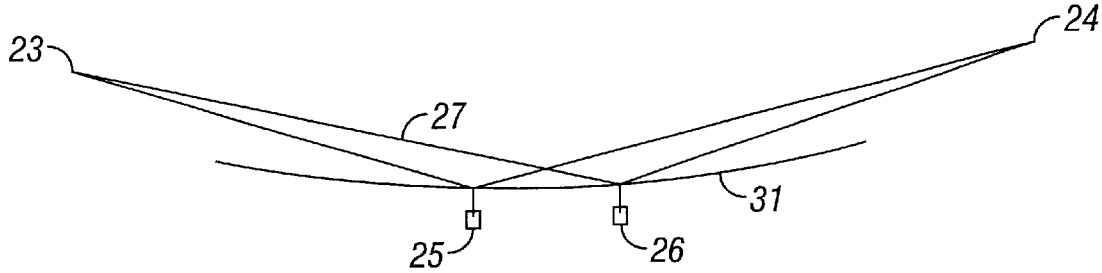
Figure 4C:
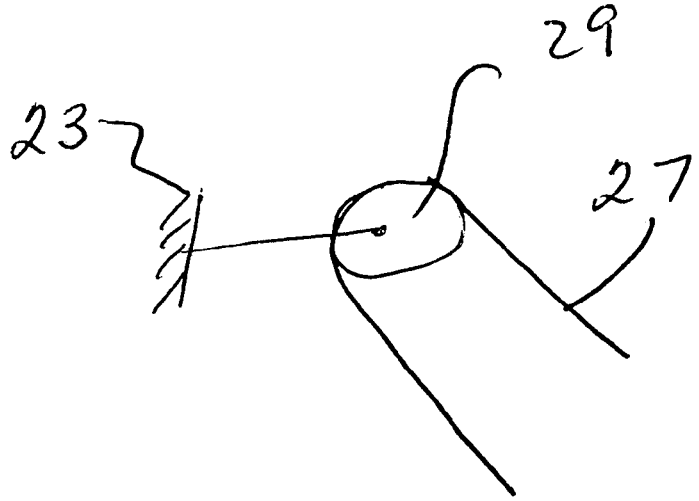

FIG. 4C illustrates an exemplary pulley according to the invention, in which a time member or cable 27 passes over the pulley wheel 29, which is secured to supports 23 (or 24), schematically illustrated. For clarity, pulleys are not otherwise shown in the drawings, but their locations are indicated as well as the direction of movement of the tie member 27.

Figure 3:
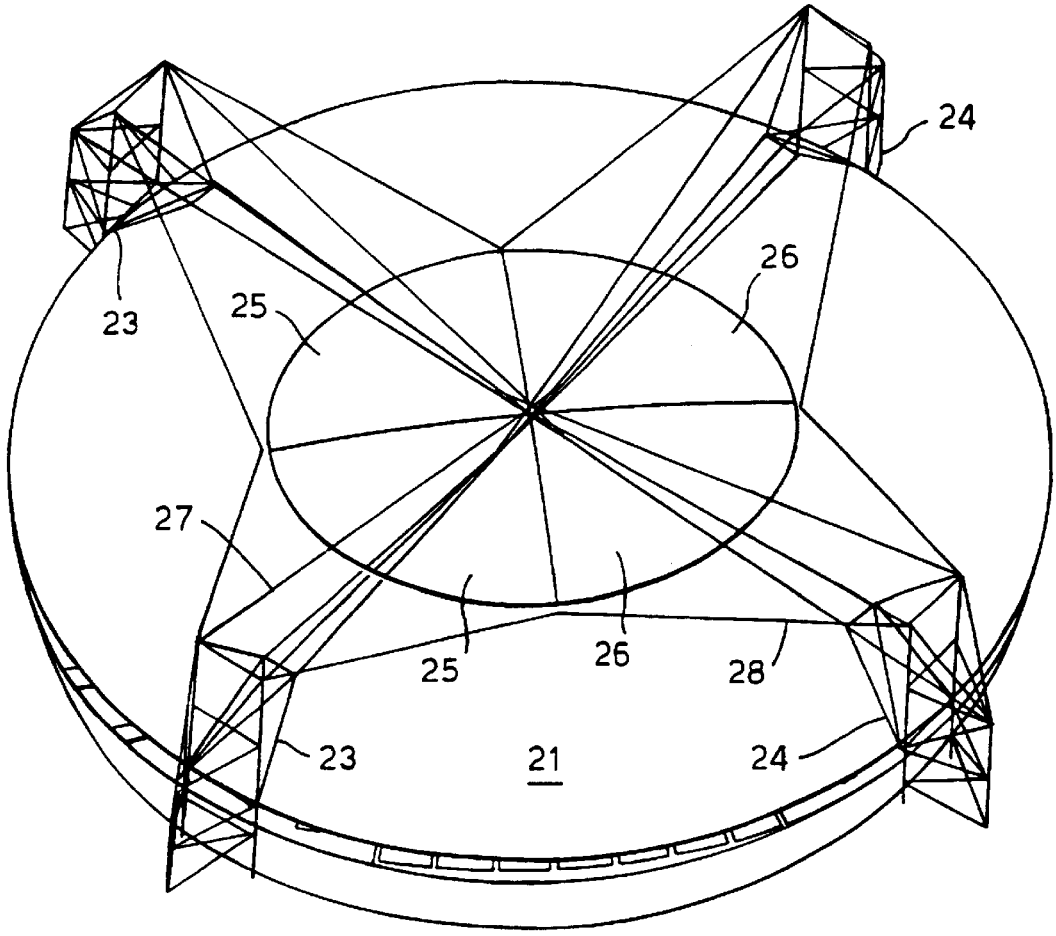

The operation of the supports 23, 24, movable roof sections 25, 26 and tie members 27 will now be described. Referring to FIGS. 4*a* and 4*b* a simplified configuration of a system according to the invention is shown, in which components corresponding to those in FIGS. 1 to 3 are numbered identically. In this example the movable roof sections 25, 26 are configured to move through an arc 31. Each movable roof section 25, 26 is attached to the tie member 27, which passes over pulleys (not shown) at each support 23, 24. The configuration is such that there is a cross-over point 32 in the centre of the system, with each movable roof members 25, 26 being on an opposite side of the cross over section 32 to the other. In use, movement of the tie member 27 around the pulleys (not shown) on the supports 23, 24 moves the two roof members 25, 26 toward each other and indicated by the arrows, until they are in a closed position of the type shown in FIG. 4*b*. Because the roof sections 25, 26 are positioned equidistant from the supports 23, 24 with respect to one another, and because they have identical weight, the tension in the tie member 27 is balanced.

Figure 5A:
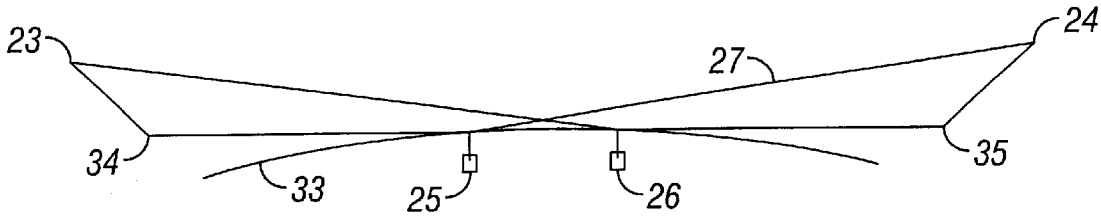
Figure 5B:
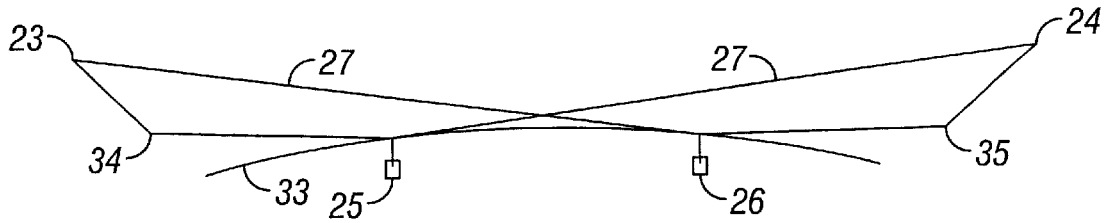

FIGS. 5*a* and 5*b* show a second example of the invention, in which components corresponding to those in FIGS. 4*a* and 4*b* are numbered identically. In this example the tie member 27 passes around additional points 34, 35 positioned below the pulleys on the supports 23, 24. This produces a movement in which the roof sections 25, 26 pass through a curve 33 having a direction of curvature opposite to that of curve 31 shown in FIGS. 4*a* and 4*b*.

Figure 6:
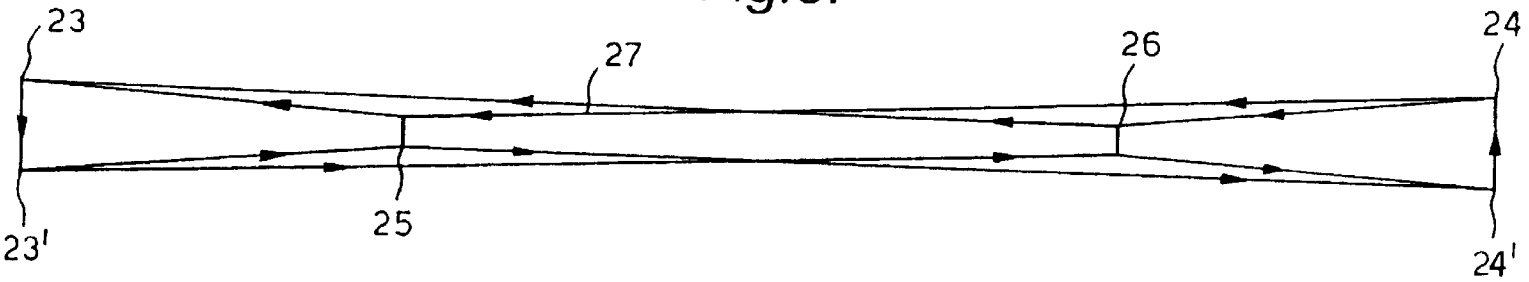
FIG. 6 is a plan view of a further example system according to the present invention.

The simplified structure shown in FIGS. 4*a* to 5*b* may be adequate in many circumstances, but there will be situations in which additional support is required and in which it is necessary to improve the system in respect of resistance to lateral forces applied to the movable roof sections 25, 26 due to high winds, etc. In such cases, a double loop arrangement of the type shown in FIGS. 6 and 7 may be employed. In this arrangement four pulley points are provided at each support member 23, 24, with the tie member 27 passing through each pulley point once in a looped configuration. The tie member 27 is movably connected at one point 1, 1*a* on each of the movable roof sections 26 and is fixed at a second point 5, 5*a* on each of the roof sections 25.

Figure 7:
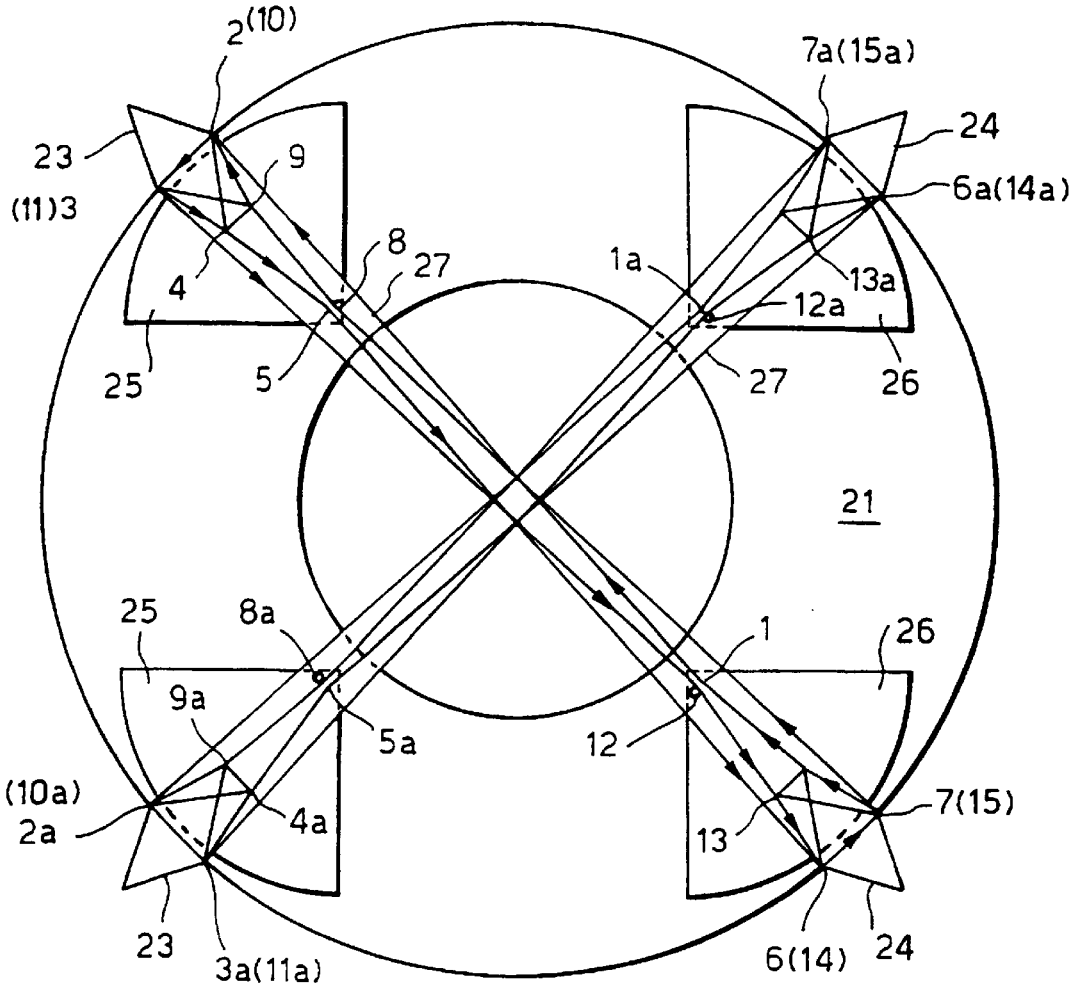
FIG. 7 is a schematic plan view of a roof which uses two systems of the present invention.

The arrangement of FIG. 7, in which components corresponding to those in previous figure are numbered identically, clearly shows the direction in that the tie member 27 is arranged around the various pulleys and fixed points. It is not important at which point the tie member 27 starts but in this example, points 1, 1*a* are designated as fixed points on respective roof sections 26. From this fixed point, the tie member 27 follows the path indicated by the ascending numbers until it returns to its starting point 1, 1*a*. The points labelled 5, 5*a* on the opposing roof sections 25 are also fixed points.

Figure 8:
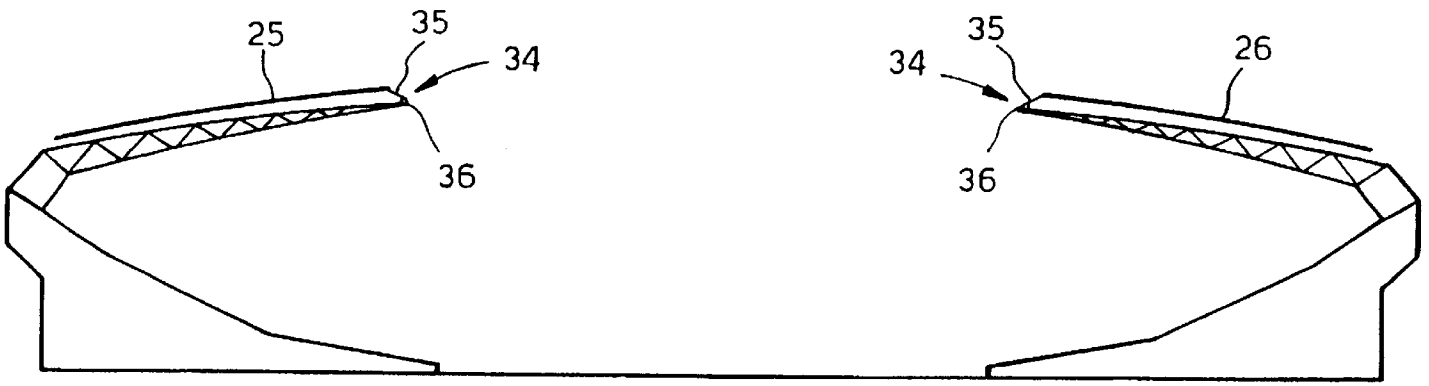
FIG. 8 is a side elevation view of a stadium having a retractable roof and a roof retaining means.

A roof retaining means 34 can be seen in FIG. 8 and is provided with a cable 35 which may be a steel cable of the sort used in the tie member. The cable 35 is attached at one end to the underside of the roof sections 25,26 by a slide mechanism (not shown) similar to that employed as a door latch. The other end of the retaining means is attached to a ring beam 36 mounted on the peripheral fixed roof section. The retaining means is constructed such that the cable is in tension when the roof sections 25,26 are in the fully retracted position.

What is claimed is:

1. A system for operating a retractable roof having at least two movable roof sections, the system comprising:

a first support having a first pulley mounted thereon;

a second support positioned opposite to and across from the first support and having a second pulley mounted thereon;

a flexible tie member passing around the first and second pulleys to form an elongate endless loop having a cross over point between the first and second supports;

wherein the first roof section is attached to the tie member at a first fixed point on the first roof section between the first support and the crossover point and is suspended at said first fixed point; and the second roof section is attached to the tie member at a second fixed point on the second roof section between the crossover point and the second support and is suspended at said second fixed point, such that, when the tie member is moved, the roof sections move in opposite directions.

2. A system according to claim 1, wherein the tie member passes through each support twice to provide resistance to lateral movement.

3. A system according to claim 2, wherein the tie member doubles back on itself at the first support.

4. A system according to claim 1, wherein the first and second fixed points on the respective first and second roof sections are, in use, equidistant from the crossover point.

5. A system according to claim 1, further comprising at least one additional pulley through which the tie member passes.

6. A system according to claim 1, including a stadium for receiving one or more roof sections of retractable roof.

7. A system, wherein the roof sections are convex.

8. A system according to claim 6, wherein the roof sections are concave.

9. A system according to claim 6, having two roof sections for each system.

10. A system according to claim 6, wherein the one or more roof sections are formed from a number of roof elements such that, in the retracted position, the roof elements are stacked one on top of another, and, in the extended position, the elements are adjacent to each other to form a roof section.

11. A system according to claim 6, further comprising retention means for preventing the retractable roof sections from being lifted when in the retracted position.

12. A system according to claim 11, wherein the retention means comprises a cable which is attached at one end to the fixed roof section and at the other end is slidably mounted on the underside of the retractable roof.

13. A system according to claim 1, including a stadium for receiving the retractable roof.

14. A stadium according to claim 13, wherein only a portion of the roof is retractable and further comprising additional tie members between the supports and the non retractable portion of the roof.

* * * * *